United States Patent [19]

Geberth, Jr.

[11] 4,389,017

[45] Jun. 21, 1983

[54] SPRAY GUN

[76] Inventor: John D. Geberth, Jr., 10 Goose Cove La., Ramsey, N.J. 07446

[21] Appl. No.: 254,376

[22] Filed: Apr. 15, 1981

[51] Int. Cl.[3] ..... B05B 1/32

[52] U.S. Cl. ..... 239/455; 239/526

[58] Field of Search ..... 239/525, 526, 575, 590, 239/455; 251/89, 90, 205

[56] References Cited

U.S. PATENT DOCUMENTS

| | | | |
|---|---|---|---|
| B 450,927 | 1/1975 | Petrovic | 239/526 |
| 3,743,188 | 7/1973 | Wagner | 239/526 X |
| 3,936,002 | 2/1976 | Geberth | 239/455 |
| 4,126,272 | 11/1978 | Geberth | 239/455 |
| 4,220,286 | 9/1980 | Geberth | 239/455 |
| 4,269,355 | 5/1981 | Geberth | 239/455 X |

*Primary Examiner*—John J. Love
*Assistant Examiner*—Gene A. Church
*Attorney, Agent, or Firm*—Joseph J. Orlando

[57] ABSTRACT

A spray gun is provided for hydraulically atomizing and spraying liquids such as paint. The spray gun comprises a body portion having a fluid passageway extending therethrough communicating with a source of pressurized fluid and a spray head portion connected to the body portion. The spray head portion is provided with a spray opening, communicating with the fluid passageway in the body portion, and with a retractable valve stem substantially transverse to and forming a part of the spray opening. A triggering mechanism operates to retract the valve stem to thereby open the spray opening.

10 Claims, 16 Drawing Figures

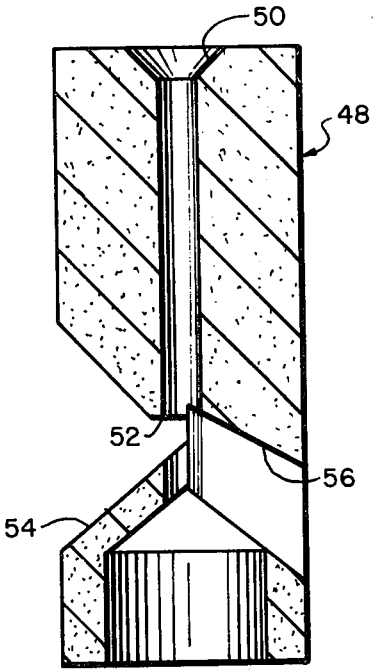
FIG.5
FIG.6
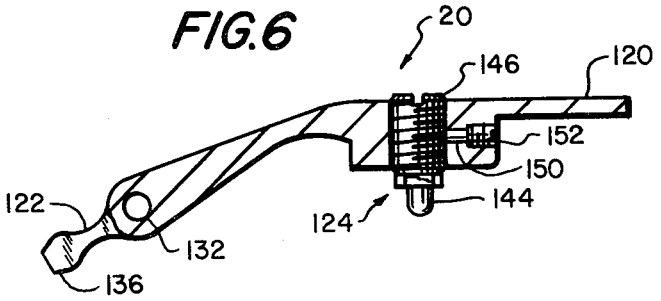
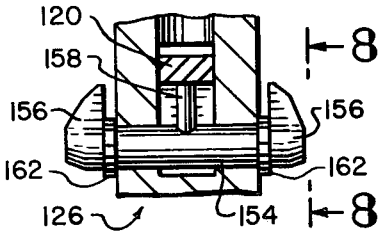
FIG.7
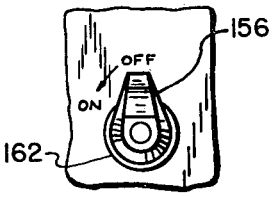
FIG.8
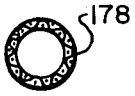
FIG.10
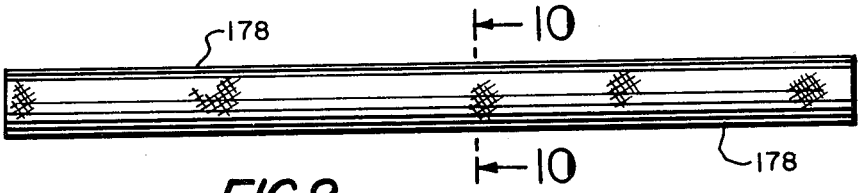
FIG.9
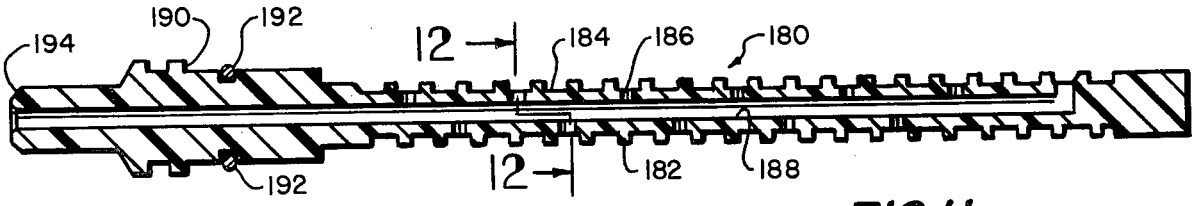
FIG.11
FIG.12
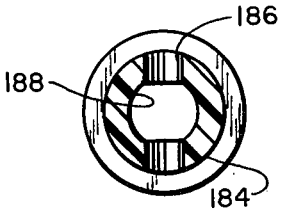

FIG.15
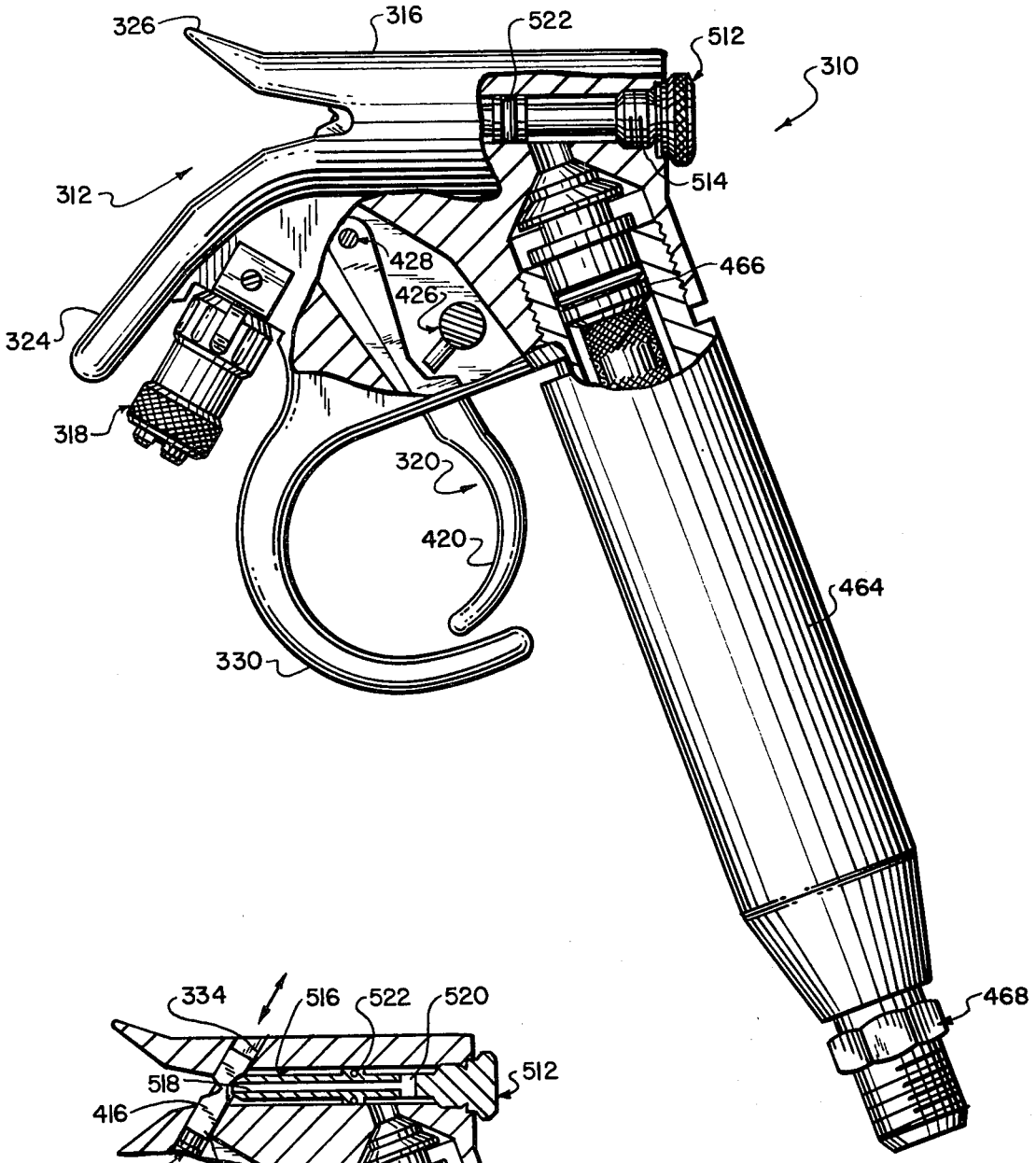
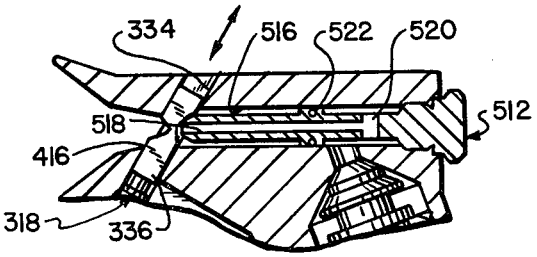
FIG.16

SPRAY GUN

The present invention relates generally to spray guns and like devices which are adapted for hydraulically atomizing and spraying liquids such as paint. More particularly, the present invention relates to such a spray gun which is novel in its construction and operation and a significant improvement over the prior art.

Hydraulic or airless paint spray guns have heretofore essentially been comprised of two main elements, the gun body and the spray tip or nozzle. The high pressure paint is directed through the gun body, which is provided with a handle so that the operator can direct the spray of paint, to the spray tip. Because of the construction of the spray tip and the pressure drop of the paint exiting the tip, the paint is finely atomized into a spray suitable for spray painting. In order to give the operator or painter a means of controlling the painting operation, an on-off valve, activated by a trigger mechanism, is provided in the gun body upstream from the spray tip. Although certain improvements have been made over the years, the on-off valve is basically a needle type valve whose stem passes externally of the paint chamber in the gun body so that it may be acted upon by the trigger mechanism. An improved version of this valve utilizes a ball valve having a thin stem attached to the ball, the stem extending externally of the paint chamber to be acted on by the trigger mechanism as in the needle type valve construction. A spring, or other biasing means, is provided to return the needle or the ball, as the case may be, to its seat when the operator releases the trigger, thus shutting off the supply of paint to the spray tip.

Although the spray gun construction above described is in universal usage, it is not without shortcomings. One problem faced by operators or users of such spray guns is leaking. Since the on-off valve, whether it be a needle type or ball valve, is positioned in the paint chamber upstream of the spray tip and the trigger mechanism is positioned outside of the paint chamber, it necessarily follows that the integrity of the paint chamber must be violated. Thus, in the above described spray gun construction the trigger mechanism operates on the on-off valve stem, which extends externally of the paint chamber, in order to activate the on-off valve. No matter how close the tolerances or how good the packing or gasket, wear must eventually destroy the seal between the valve stem and the exit from the paint chamber resulting in the high pressure paint leaking from the chamber. A leaking problem also occasionally arises when a particle of paint or other material positions itself between the on-off valve and its seat thereby preventing the needle or ball from positively closing on its seat. In such a case the operator finds that he cannot completely shut off the paint exiting from the spray tip. His only recourse in this situation is to shut off the paint pump which pressurizes the paint and dismantle the spray gun so that the particle can be cleaned from the on-off valve.

Another drawback encountered with the type of spray gun described above does not occur only with wear or on an occasional basis, but rather it occurs each time an operator paints with such a gun. Each time during the painting operation that the operator pulls the trigger of such a spray gun, a globule of paint at the spray tip opening is propelled by the sudden pressure increase onto the spray surface. This results in an unsightly drip or heavy spot on the spray surface. The appearance of this globule of paint is a result of the spray gun construction where the on-off valve is upstream of the spray tip. When the on-off valve is closed and spray painting momentarily interrupted, the paint in-between the valve and the spray tip is no longer under pressure resulting in a relaxation of the associated parts in that portion of the spray gun. Since these associated parts are connected together using gaskets and like materials, a certain amount of contraction in that portion of the spray gun occurs. This contraction forces a small amount of the paint in this area to exit from the opening of the spray tip and form a globule outside of the opening. Because of this problem if is often, if now always, impossible to obtain a flawless finish when spray painting by means of hydraulic atomization.

As noted above, hydraulic paint spray guns heretofore utilized an on-off needle type valve upstream from the spray tip. This needle type valve is operated by a trigger which, when depressed, displaces the needle from its seat thus allowing the high pressure paint to flow to the spray tip and exit therefrom. The spray of paint exiting the spray tip is thus fixed by the extent of the spray opening and the amount of paint flowing past the needle valve. It has not heretofore been possible to construct such a spray gun such that an operator can easily control the spray of paint. In order to control the flow of paint by means of the on-off valve, a true tapering needle valve must necessarily be utilized. However, such a needle valve would wear excessively because of the smallness of the orifices needed and the flow required. Also, the use of such a valve would result in objectionable clogging at the valve port due to the small clearances available and the size of the paint particles involved. In my earlier patent, U.S. Pat. No. 3,936,002, granted Feb. 3, 1976, I have attempted to aid in this situation by describing an adjustable spray tip which permits the operator to select the spray fan or paint flow desired for a given painting operation. This adjustable spray tip does give some versatility to the hydraulic paint spray gun. However, optimum control over the painting operation would permit the operator to select that fan spray or paint flow he desired as he painted.

It is, therefore, a primary object of the present invention to provide a spray gun, adapted for the hydraulic atomization and spraying of paint, having a novel and improved construction which eliminates leaks heretofore inherent in such spray guns, results in a spray paint finish superior to that heretofore experienced with the use of such spray guns, and gives optimum control over the painting operation.

The above object, as well as others which will hereinafter become apparent, is accomplished in accordance with the present invention by the provision of a spray gun for hydraulically atomizing paint wherein the control valve for the spray thereof is incorporated in the spray tip. Briefly described, the spray gun of the present invention comprises a body portion and a spray head portion. The body portion is provided with a fluid passageway extending therethrough, one end of which communicates with a source of pressurized paint and the other end of which terminates at the spray head portion. The spray head is provided with a spray opening, communicating with the fluid passageway in the body portion, and with a retractable valve stem substantially transverse to and forming a part of the spray opening. A triggering mechanism on the spray gun operates to selectively retract the valve stem to thereby open the spray opening and permit the high pressure paint to escape therethrough and be atomized.

The present invention will be described and understood more readily when considered together with the accompanying drawings, in which:

FIG. 5 is an enlarged cross-sectional view of an insert fitted into the portion of the spray head shown in FIG. 4;

FIG. 6 is an enlarged cross-sectional view in elevation of the trigger for the spray gun of the present invention;

FIG. 7 is an enlarged cross-sectional view in elevation of a portion of the spray gun of the present invention showing the lock for the trigger;

FIG. 8 is an enlarged side elevational view of a portion of the spray gun of the present invention showing the trigger lock and taken along line 8—8 of FIG. 7;

FIG. 9 is a side elevational view of the filter screen for the spray gun of the present invention;

FIG. 10 is a cross-sectional view of the filter screen of FIG. 9 taken along the line 10—10 of FIG. 9;

FIG. 11 is a side elevational view of the filter body for the spray gun of the present invention;

FIG. 12 is a cross-sectional view of the filter body of FIG. 11 taken along the line 12—12 of FIG. 11;

FIG. 15 is a side elevational view, partly in cross-section, of another embodiment of the spray gun of the present invention; and FIG. 16 is a cross-sectional view of a portion of the spray head of the spray gun shown in FIG. 15.

Figure 1:
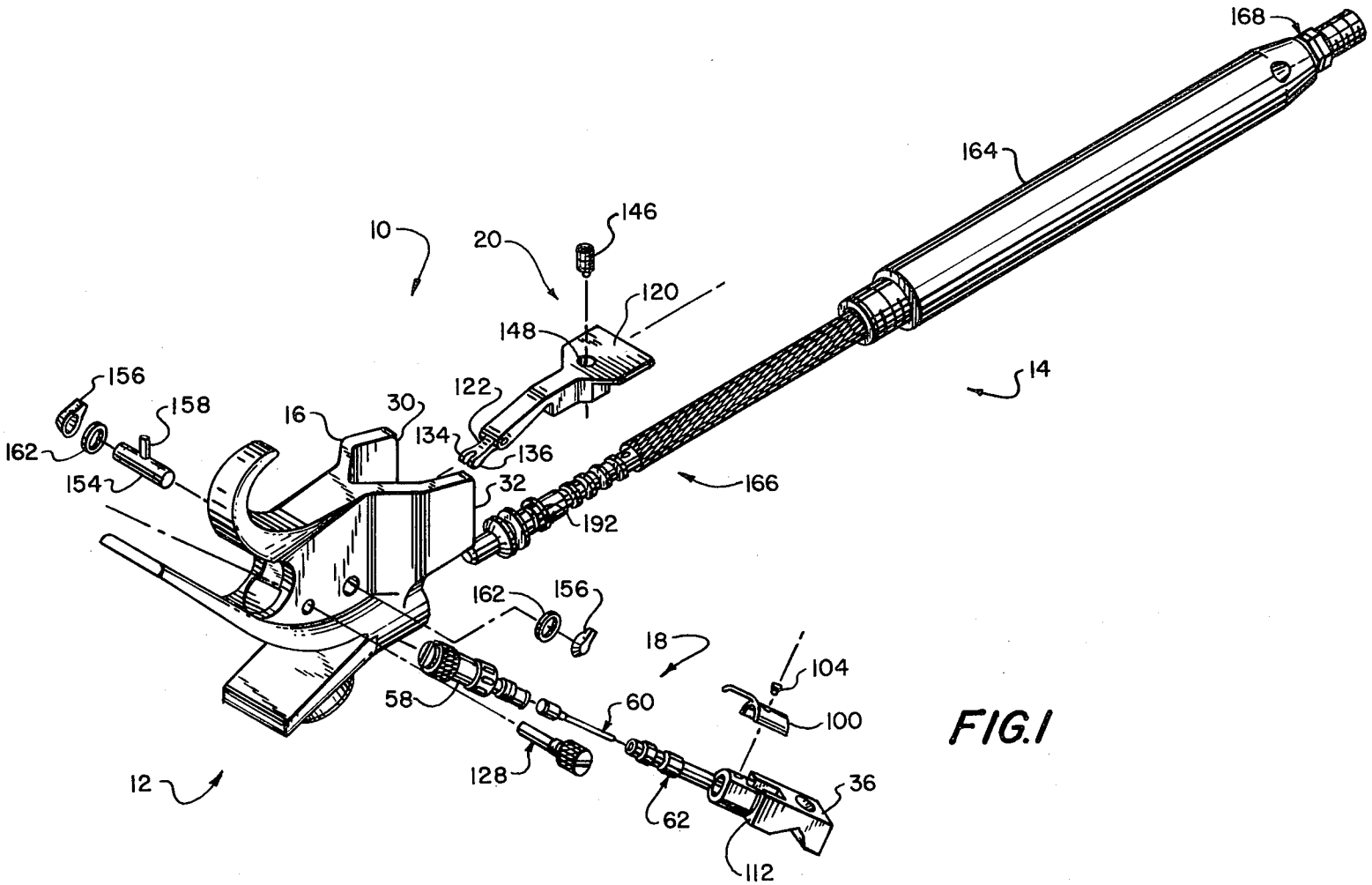
FIG. 1 is an exploded perspective view of the spray gun according to the present invention.
Figure 2:
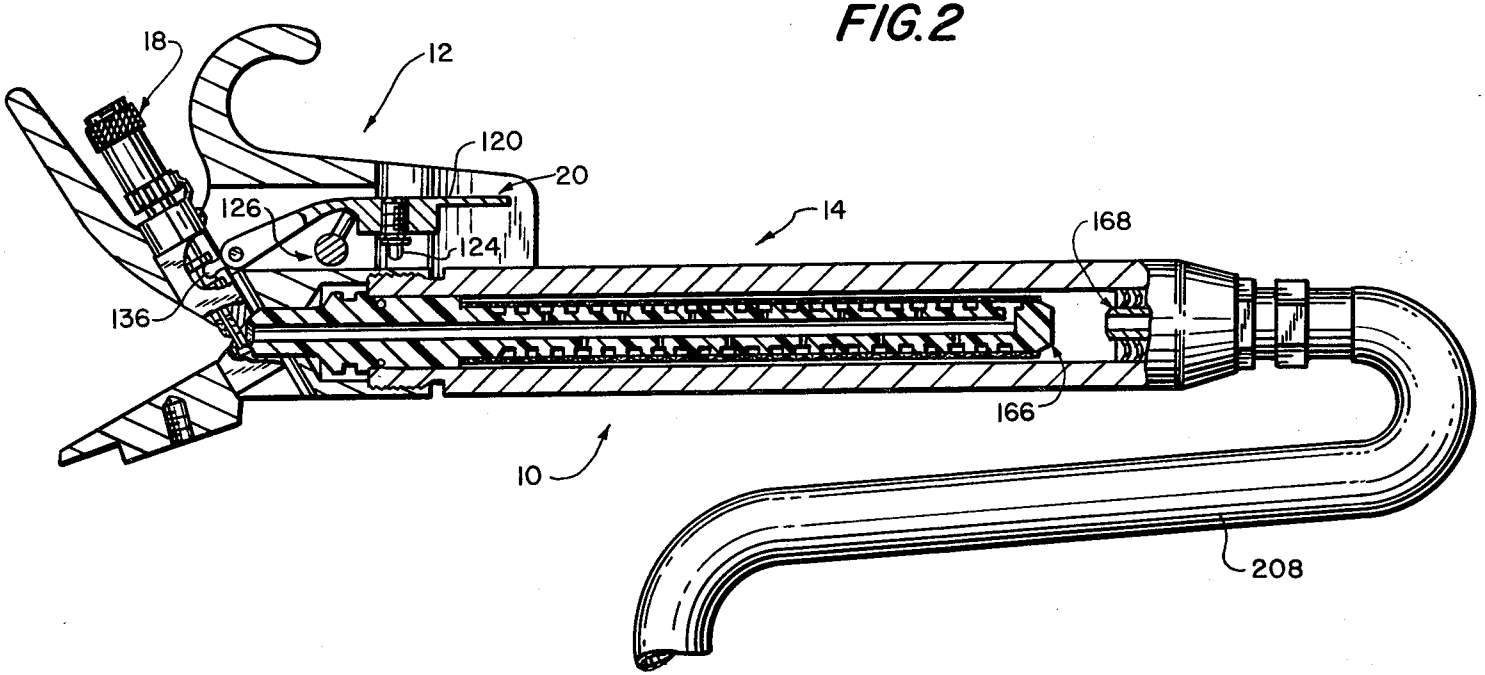
FIG. 2 is a cross-sectional view in elevation of the spray gun according to the present invention.

Referring now to the drawings, there is shown in FIGS. 1 and 2 a spray gun, designated 10, which comprises two main elements, a spray head portion, generally designated 12, and a body portion, generally designated 14. Spray head portion 12 comprises a spray tip housing, designated 16, a spray tip assembly, designated 18, and a trigger assembly, designated 20. As clearly seen in FIG. 3, spray tip housing 16 is basically formed with a hook 22 for the purpose of hanging spray gun 10 when not in use, bifurcated protuberances 24 and 26 which act as a spray tip guard, threaded bore 28 for connecting spray head portion 12 to body portion 14, wings 30 and 32 which act as a trigger guard, and bore 34 for accepting spray tip assembly 18.

Figure 4:
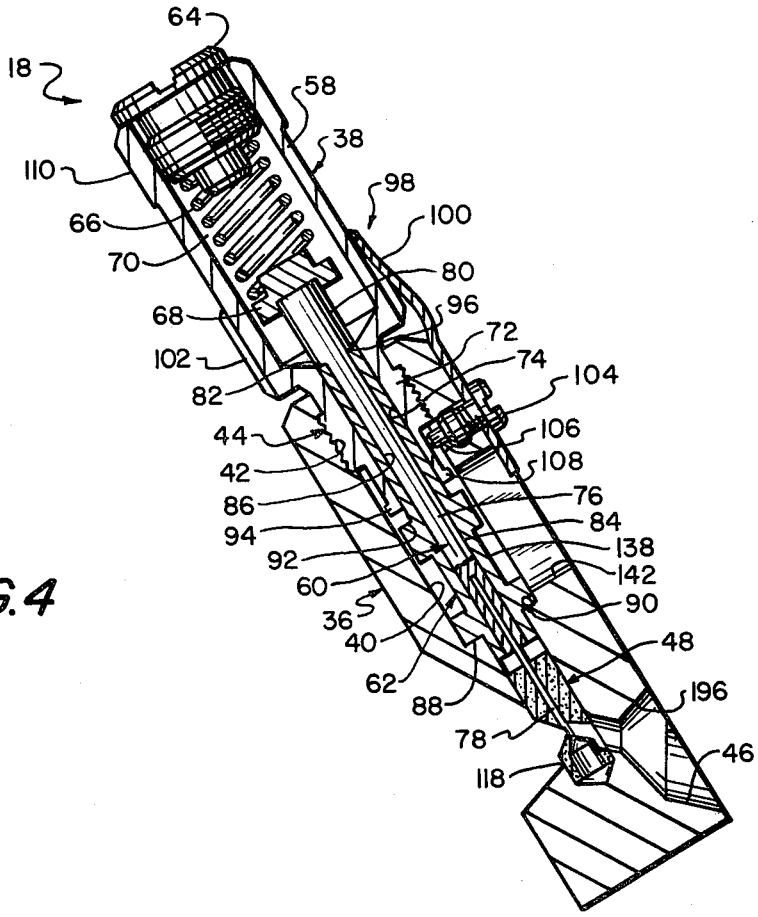
FIG. 4 is an enlarged cross-sectional view in elevation of another portion of the spray head of the spray gun of the present invention.

As clearly seen in FIG. 4, spray tip assembly 18 includes a housing, generally designated 36, and a valve pin assembly, generally designated 38. Housing 36 is provided with a bore, designated 40, which has a female threaded portion at 42 in order to threadably engage the male threaded portion 44 of valve pin assembly 38. Bore 40 extends partially through housing 36 to intersect bore 46 therein which aligns with bore 28 of spray tip housing 16 when assembly 18 is united with housing 16. A spray valve, generally designated 48, is press fitted into bore 40 of housing 36. As clearly seen in FIG. 5, spray valve 48 is provided with a valve bore 50, co-axially aligned with bore 40 of housing 36, a spray opening 52, formed by the intersection of groove 54 with valve bore 50, and an elongated opening, designated 56, formed opposite spray opening 52 and which is aligned with bore 46 of housing 36, as seen in FIG. 4.

Valve pin assembly 38 basically comprises a housing, designated 58, a valve pin cluster, designated 60, and a valve pin actuator, designated 62. Valve pin housing 58 includes a retaining screw 64, a valve spring 66 and a spring guide 68 all housed within a spring compartment, designated 70. A cylindrically shaped barrel portion 72 of housing 58 is threadably engaged with bore 40 of housing 36, as described above, and is provided with a bore 74 opening into compartment 70 and co-axially aligned with bore 40 of housing 36. Valve pin cluster 60 basically comprises a valve pin holder, designated 76, and a valve pin, designated 78. Valve pin holder 76 is provided with a head portion 80, having shoulder 82, and a shank portion 84 into which valve pin 78 is press fitted. Head 80 has a diameter which is slightly less than the diameter of bore 74 of housing 58 to thereby permit head 80 to pass therethrough. Valve pin actuator 62 is shaped and adapted to fit into bore 74 of housing 58 and is provided with a bore 86 adapted to receive shank portion 84 of valve pin holder 76. Shoulder 88, near the lower extremity of actuator 62, is adapted to engage with shoulder 90 in bore 40 of housing 36 to thereby act as a stop to the continued downward travel of valve pin 78 beyond spray opening 52. Shoulder 92, located above shoulder 88, is adapted to engage with shoulder 94 at the lower extremity of barrel portion 72 of housing 58.

In assembling spray tip assembly 18, shank 84 of valve pin cluster 60 is inserted into bore 86 of actuator 62 so that shoulder 82 of pin cluster 60 engages the end 96 of actuator 62. This assemblage of pin cluster 60 and actuator 62 is then inserted into bore 74 of housing 58 so that head portion 80 of pin cluster 60 engages spring guide 68. Next, barrel portion 72 of housing 58 is threaded into bore 40 of housing 36 such that valve pin 78 enters into valve bore 50 of spray valve 48, as clearly seen in FIG. 4. A ratchet mechanism, designated 98, which may comprise a spring clip 100 engageable with grooved portion 102 of valve pin assembly housing 58 serves to prevent the inadvertent movement of valve pin assembly 38. Spring clip 100 may be secured to housing 36 by screw 104 which may also be provided with a stem 106 extending into bore 40 which together with stop 108 on portion 72 of valve pin housing 58 prevents the inadvertent withdrawal of housing 58 from housing 36.

Figure 3:
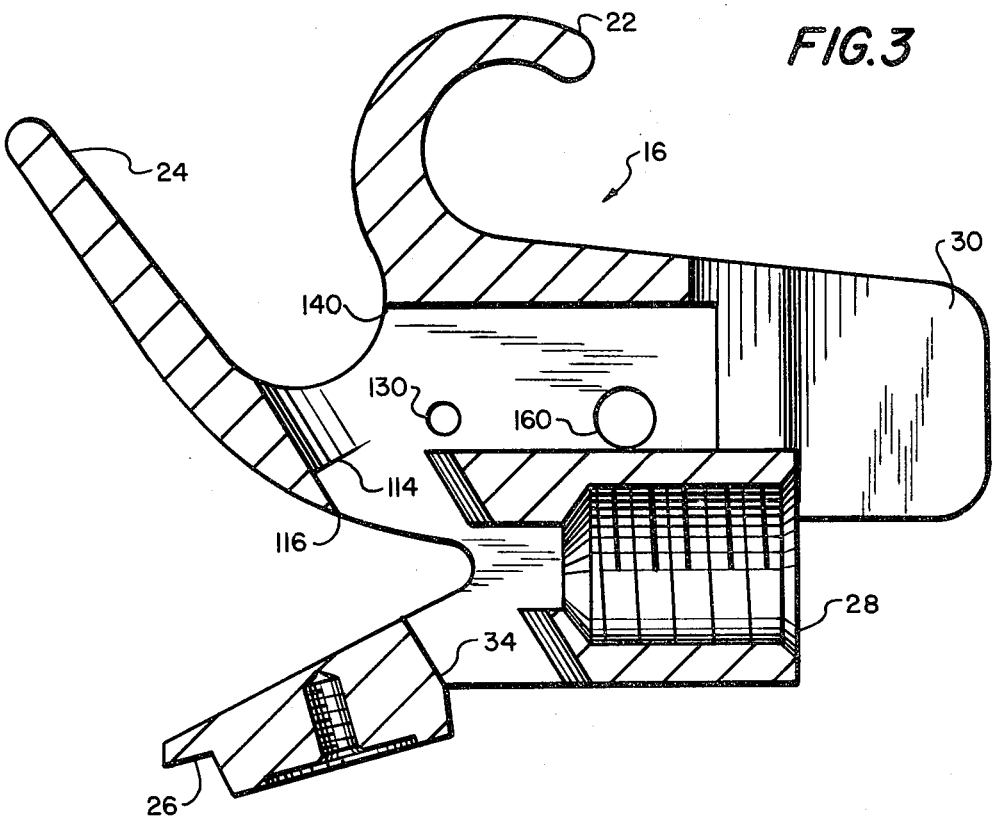
FIG. 3 is an enlarged cross-sectional view in elevation of a portion of the spray head of the spray gun of the present invention.

Spray tip assembly 18 is now ready to be combined with spray tip housing 16 and trigger assembly 20 to form spray head portion 12 of spray gun 10. Spray tip assembly 18 is inserted into bore 34 of housing 16 by passing the adjustment knob 110 of valve pin assembly 38 therethrough, as illustrated in FIG. 1, until the shoulder 112 of spray tip housing 36 contacts and engages with shoulder 114 in bore 34. Spray tip assembly 18 must be so positioned within bore 34 of housing 16 that bore 46 is aligned with bore 28 of housing 16. This, of course, is accomplished in part by the positioning of shoulder 114 in bore 34 and in part by the posturing of spray tip assembly 18. Also, a forward opening, designated 116, is provided in bore 34 of spray tip housing 16 between bifurcated protuberances 24 and 26, as seen in FIG. 3. This opening 116 coincides with opening 118 in bore 40 of housing 36 which in turn coincides with groove 54 in spray valve 48 defining spray opening 52.

Trigger assembly 20 comprises a trigger, generally designated 120, an actuating arm, generally designated 122, a spray limit indicator, generally designated 124, and a trigger lock mechanism, generally designated 126. Trigger 120 is pivotally connected to spray tip housing 16 by means of pin 128 which passes through opening 130 in housing 16 and opening 132 in trigger 120. Actuating arm 122 is connected to trigger 120 at pivot pin opening 132 such that when trigger 120 is pivotally connected to housing 16, a downward movement of the trigger translates into an upward movement of the actuating arm, as clearly seen in FIGS. 2 and 6. Fingers 134 and 136 are provided on actuating arm 122 for the purpose of engaging notch 138 in actuator 62 when passed through opening 140 in housing 16 and opening 142 in housing 36. Thus, when spray tip assembly 18, spray tip housing 16 and trigger assembly 20 are combined, a depressing movement of trigger 120 will provide a lifting movement to actuator 62 which in turn will lift valve pin 78 in valve bore 50. Spray limit indicator 124 comprises a spring biased pin, designated 144, which is retained within an adjustment screw, designated 146. Adjustment screw 146 is threadably engaged in hole 148 in trigger 120 such that pin 144 contacts spray tip housing 16 when trigger 120 is depressed sufficiently. Adjustment screw 146 is held in place within hole 148 by the pressure exerted thereon by the nylon lock 150 and set-screw 152. The trigger lock mechanism 126, as clearly seen in FIGS. 7 and 8, comprises a rotatable pin, designated 154, selector knobs, designated 156, and dog 158 centrally located on pin 154. Pin 154 is fitted into hole 160 in spray tip housing 16 and is fitted with the selector knobs 156 at either end. To facilitate rotation of pin 154, washers 162 are provided adjacent knobs 156. Turning of either knob will rotate pin 154 and move dog 158 from a vertical position when the knob is at the "off" position to an essentially horizontal position when the knob is at the "on" position. In the "off" position, dog 158 contacts the underside of trigger 120 to prevent the inadvertent downward movement or depression of the trigger.

Figure 13:
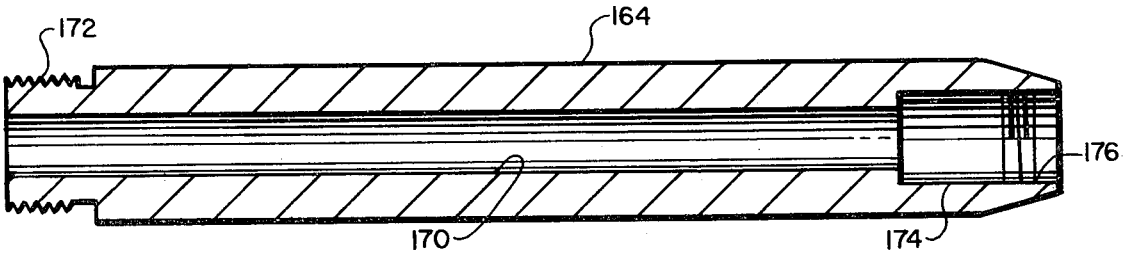
FIG. 13 is a cross-sectional view in elevation of the body portion of the spray gun of the present invention.

Body portion 14 of spray gun 10, which serves as the handle for the gun, basically comprises a tubular shaped gun body, generally designated 164, a filter, generally designated 166, and a hose connecting means, generally designated 168. As clearly seen in FIG. 13, tubular gun body 164 is provided with a centrally located chamber, designated 170, extending through the length of the body. One end of gun body 164 is provided with a male threaded portion, designated 172, for threadable engagement with the female threaded bore 28 of spray tip housing 16. The end of chamber 170 opposite the threaded end 172 of body 164 is expanded slightly at 174 and is provided with a female threaded portion, designated 176, for threadable engagement with hose connecting means 168.

Figure 14:
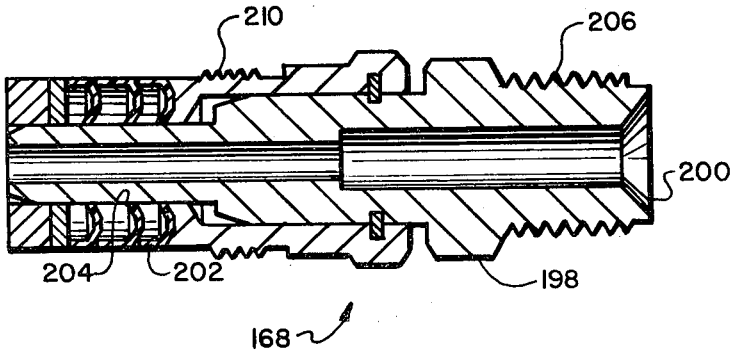
FIG. 14 is an enlarged cross-sectional view in elevation of the swivel connection of the spray gun of the present invention.

Filter 166 is comprised of a filter element, designated 178, and a filter body, designated 180. Filter element 178, as seen in FIGS. 9 and 10, is tubular shaped and may be in the form of a wire screen or mesh. Filter body 180, as clearly seen in FIGS. 11 and 12, is provided with a raised spiral portion, designated 182, having a diameter such that filter element 178 fits thereabout and is kept away from the lands 184 between the raised spiral. In the lands 184, a plurality of fluid openings 186 are provided which communicate with fluid bore 188 in filter body 180. Fluid bore 188 extends from the front end of filter body 180 and terminates near its other end so that all fluid entering bore 188 first passes through filter element 178. An annular shoulder, designated 190, is provided near the front end of filter body 180 for the purpose of engaging with the threaded end 172 of tubular gun body 164. An "O" ring, designated 192, serves to seal chamber 170 from the spray head portion 12 when filter 166 is inserted into the chamber 170 of gun body 164. The front end of filter body 180 is beveled at 194 so that when body portion 14 is threaded sufficiently into spray head portion 12 it contacts and mates with the tapered portion 196 of bore 46 of housing 36, thereby providing a suitable seal with respect to spray head portion 12 and simultaneously securely holding spray tip assembly 18 in position. Hose connecting means 168 is clearly shown in FIG. 14 as a swivel connection, although any suitable connecting means may be utilized. Hose connecting means 168 basically comprises a rotatable hose connector 198 having a central fluid bore 200 therethrough, a gun body connector 202 adapted for swivel engagement with hose connector 198, and swivel seal 204. Hose connector 198 may be threaded at 206 for threadable engagement with a hose 208, as seen in FIG. 2, and gun body connector 202 is threaded at 210 for threadable engagement with gun body 164.

When spray head portion 12 and body portion 14 have been assembled and connected to a source of fluid paint under pressure via hose 208, spray gun 10 is ready for operation. In operating spray gun 10, the operator first makes adjustment to housing 58 and spray limit indicator 124 as desired. Adjusting housing 58 by means of turning adjustment knob 110, the operator can choose the maximum extent of the fan spray he wishes. The positioning of housing 58 determines the amount of travel of valve pin cluster 60 and thus valve pin 78 which in turn defines the maximum extent of spray opening 52 and the maximum extent of the spray issuing therefrom. Adjustment of the spray limit indicator 124 by turning adjustment screw 146 in or out of trigger 120 positions pin 144 so that at some intermediate position of the trigger, pin 144 contacts housing 16 and, because of its spring bias, greater effort is required by the operator to continue depressing trigger 120. Properly adjusted, spray limit indicator 124 gives the operator a reference point in his painting operation such that he is aware that the fan spray has a certain extent when he reaches the intermediate position of the trigger and a greater extent when he surpasses this position. After having made these adjustments, the operator grasps body portion 14 of spray gun 10, which serves as a handle, and, after turning selector knob 156 to the "on" position and thus releasing the trigger lock mechanism 126, depresses trigger 120 to commence spraying. Valve pin 78 is biased by spring 66 to normally maintain spray opening 52 closed. A depression of trigger 120 results in an upward movement of valve pin 78 because of the action of fingers 134 and 136 of actuating arm 122 upon valve pin actuator 62. This upward movement of valve pin 78 opens spray opening 52, the maximum extent of which having been determined by the operator by his adjustment of housing 58. The fluid paint, which has entered spray gun 10 by means of hose 208, fills chamber 170 of gun body 164 passing through filter element 178 and fluid openings 186 to fill fluid bore 188 of filter body 180. When spray opening 52 is opened, as above described, the high pressure fluid paint is forced therethrough and atomized to form a fan spray. During the painting operation, the operator is able to selectively retract valve pin 78 by how much he depresses trigger 120 thus determining the extent of the opening of spray opening 52 and the resulting paint spray. Thus, the operator has complete control over the painting operation and can select the paint spray desired as he goes. In order to stop spray painting, the operator merely releases his pressure on trigger 120 and spring 66 will bias valve pin 78 to close spray opening 52.

Referring now to FIGS. 15 and 16, another embodiment of the spray gun of the present invention is depicted wherein like numerals indicate like parts of the previously described embodiment. Spray gun 310 is basically similar to spray gun 10 in everything but shape. Spray gun 310 has basically the shape of a conventional spray gun. Thus, gun body 464, which houses filter 466 and has hose connecting means 468, forms a pistol like handle for the spray gun. The spray head portion, designated 312, comprises a spray tip housing 316, a spray tip assembly 318 and a trigger assembly 320. Spray tip assembly 318 is or may be identical in all respects to the spray tip assembly 18 of the previously described embodiment. Spray tip housing 316, although very similar to spray tip housing 16, differs in some respects particularly with regard to bore 334 and the positioning of trigger assembly 320. Bore 334 of housing 316 is adapted to accept spray tip assembly 318 from the top of housing 316, as indicated in FIG. 16, rather than from the bottom of the housing as described in the previous embodiment. This altered positioning of spray tip assembly 318 necessitates the respositioning of trigger 420 such that the operator's index finger may be used to pull trigger 420. Trigger 420 is therefore pivotally attached to housing 316 by means of pin 428 so as to cause actuating arm 422 (not shown) to impart a downward movement to valve pin 378 (not shown) to thereby open spray opening 352 (not shown) when trigger 420 is pulled. Basically in order to retain spray tip assembly 318 in housing 316, a retaining member, designated 512, is provided, which is similar to filter body 180 of the previous embodiment and operates to securely hold assembly 318 in position in a similar manner. Retaining member 512 is threadably engaged with housing 316 at 514 and is housed in fluid chamber 516 of housing 316. Retaining member 512 is provided with a fluid bore 518 extending partially therethrough which communicates with chamber 516 by means of fluid openings 520. The opening of bore 518 of retaining member 512 coincides with bore 346 (not shown) of housing 336 thereby permitting the fluid paint to be transmitted to spray opening 352 when valve pin 378 is opened. An "O" ring, designated 522, seals off that portion of fluid chamber 516 near spray tip housing 336 from the high pressure fluid that enters the chamber from filter 466 in gun body 464. Spray gun 310 is operated similarly to spray gun 10 except that the operator grasps the gun and pulls the trigger 420 as he does a conventional spray gun.

It is to be understood that the foregoing general and detailed descriptions are explanatory of the present invention and are not to be interpreted as restrictive of the scope of the following claims.

What is claimed is:

1. A spray gun adapted for hydraulically atomizing and spraying liquids having attached thereto conduit means communicating with a source of liquid under pressure, said spray gun including:

(a) a handle portion;

(b) a spray head portion connected to said handle portion;

(c) a fluid bore in said spray head portion communicating with said source of pressurized liquid via said conduit means and terminating in a spray opening in said spray head;

(d) a valve bore in said spray head portion intersecting said fluid bore adjacent said spray opening;

(e) a retractable valve stem in said valve bore which, upon retraction, unobstructs said spray opening and the amount of such retraction defining the extent of the opening of said spray opening;

(f) means biasing said retractable valve stem to obstruct said spray opening; and (g) trigger means for retracting said valve stem against the biasing action of said biasing means to thereby unobstruct said spray opening to permit spraying of said liquid and selectively defining the extent of valve stem retraction.

2. The spray gun as defined in claim 1 wherein said valve bore is substantially transverse to said fluid bore.

3. The spray gun as defined in claim 1 which further includes a filter upstream of said spray opening through which the liquid passes prior to spraying.

4. The spray gun as defined in claim 3 wherein said filter is housed in said handle portion of the spray gun and said conduit means is attached to said handle portion.

5. The spray gun as defined in claim 4 wherein the attachment of said conduit means to said handle portion is a swivel attachment.

6. The spray gun as defined in claim 1 which further includes adjustment means for adjusting the extent to which said valve stem may be retracted by said trigger means thereby limiting the extent of the opening of said spray opening.

7. The spray gun as defined in claim 6 wherein the adjustment means includes an adjustably moveable limit stop which limits the extent to which said valve stem may be retracted by said trigger means.

8. The spray gun as defined in claim 7 wherein the adjustable movement of said limit stop is axial with respect to said valve stem.

9. The spray gun as defined in claim 8 wherein the axial adjustment of said limit stop is provided by threadable engagement of said limit stop with said spray head portion.

10. A spray gun adapted for hydraulically atomizing and spraying liquids having attached thereto conduit means communicating with a source of liquid under pressure, said spray gun including:

(a) a handle portion having a swivel attachment for attaching to said conduit means;

(b) a filter housed in said handle portion through which said liquid passes;

(c) a spray head portion connected to said handle portion to receive said liquid;

(d) a fluid bore in said spray head portion communicating with the liquid received from said handle portion and terminating in a spray opening in said spray head;

(e) a valve bore in said spray head substantially transverse to and intersecting said fluid bore adjacent said spray opening;

(f) a retractable valve stem in said valve bore which, upon retraction, unobstructs said spray opening and the amount of such retraction defining the extent of the opening of said spray opening;

(g) means biasing said retractable valve stem to obstruct said spray opening;

(h) trigger means for retracting said valve stem against the biasing action of said biasing means to thereby unobstruct said spray opening to permit spraying of said liquid and selectively defining the extent of valve stem retraction; and (i) an adjustably moveable limit stop which limits the extent to which said valve stem may be retracted by said trigger means thereby limiting the extent of the opening of said spray opening.

* * * * *